US007221890B2

(12) United States Patent
Nishimura

(10) Patent No.: US 7,221,890 B2
(45) Date of Patent: May 22, 2007

(54) IMAGE FORMING APPARATUS

(75) Inventor: Soichiro Nishimura, Handa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 73 days.

(21) Appl. No.: 10/951,872

(22) Filed: Sep. 29, 2004

(65) Prior Publication Data

US 2005/0100364 A1 May 12, 2005

(30) Foreign Application Priority Data

Oct. 2, 2003 (JP) ..... 2003-344654

(51) Int. Cl.
*G03G 15/30* (2006.01)

(52) U.S. Cl. ..... 399/149; 399/299; 399/353; 399/354

(58) Field of Classification Search ..... 399/149, 399/299, 353, 354, 150
See application file for complete search history.

(56) References Cited

U.S. PATENT DOCUMENTS

| | | | | |
|---|---|---|---|---|
| 6,029,033 | A * | 2/2000 | Kawasaki | 399/149 |
| 6,928,252 | B2 | 8/2005 | Takami et al. | |
| 2003/0039495 | A1 | 2/2003 | Takami et al. | |
| 2003/0175042 | A1* | 9/2003 | Nishimura | 399/98 |
| 2004/0022556 | A1* | 2/2004 | Nomura | 399/116 |
| 2004/0062568 | A1* | 4/2004 | Nukada et al. | 399/159 |
| 2004/0086309 | A1* | 5/2004 | Ohara et al. | 399/353 |
| 2004/0179860 | A1* | 9/2004 | Watanabe et al. | 399/149 |
| 2005/0063745 | A1* | 3/2005 | Yanagizawa et al. | 399/353 |
| 2005/0100364 | A1* | 5/2005 | Nishimura | 399/149 |

FOREIGN PATENT DOCUMENTS

| | | |
|---|---|---|
| JP | 5-053482 | 3/1993 |
| JP | A 2001-282069 | 10/2001 |

* cited by examiner

*Primary Examiner*—David M. Gray
*Assistant Examiner*—Ryan D. Walsh
(74) *Attorney, Agent, or Firm*—Oliff & Berridge, PLC

(57) ABSTRACT

An apparatus having image forming units to form respective toner images of different colors on a toner-image receiving medium, each unit including an image carrier, a static-latent-image forming portion to form a static latent image on the image carrier, a developing portion to apply a toner of the corresponding color to the image carrier, for forming the toner image on the image carrier, and a toner transferring portion to transfer the toner image from the image carrier to the medium, wherein the image forming units are disposed so as to be opposed to the medium and operable to sequentially transfer the toner images from the image carriers to the medium, and the developing portion of each unit is operable to adsorb the toner remaining on the image carrier after the toner image is transferred to the medium, and wherein at least the image forming unit located at the most upstream position of the apparatus is provided with a dust removing portion to remove, from the image carrier, a dust which has been transferred to the image carrier during a transfer of the toner image from the image carrier to the medium.

24 Claims, 8 Drawing Sheets

IMAGE FORMING APPARATUS

The present application is based on Japanese Patent Application No. 2003-344654 filed on Oct. 2, 2003, the content of which is incorporated herein by reference.

BACKGROUND OF THE INVENTION

1. Field of the Invention

The present invention relates in general to an image forming such as a color laser printer.

2. Discussion of Related Art

A conventional image forming apparatus such as a color laser printer is arranged to form a static latent image on a surface of an image carrier such as a photosensitive or photoconductive drum, and apply a toner to the surface of the image carrier, for thereby forming a toner image on the image carrier. This process is repeated for each of four toner images of different colors, which are formed on the respective image carriers, using respective yellow (Y), magenta (M), cyan (C) and black (K) toners, so that a color image is formed on a recording medium such as a sheet of paper, with the toner images of different colors being sequentially transferred from the respective image carriers to the recording medium.

The toner image of each color is transmitted from the corresponding image carrier directly to the recording medium while the recording medium is fed by a conveyor belt, or indirectly to the recording medium via an intermediate image transfer belt. In the latter method, the toner images of different colors are first transferred from the image carriers to the intermediate image transfer belt, to form the color image on the transfer belt, and the thus formed color image is transferred from the transfer belt to the recording medium. In either of these two methods, the toners inevitably remain on the surfaces of the image carriers after the toner images are transferred the surfaces.

To remove the remaining toner from each image carrier, the conventional image forming apparatus is provided with a cleaner mechanism such as a blade device, which is arranged to remove the toner by scraping the surface of the image carrier. Alternatively, a developing device of the image forming apparatus which includes a developing roller operable to apply the toner to the surface of the image carrier is electrically controlled such that a portion of the toner which remains on the image carrier and which does not form the toner image is adsorbed onto the surface of the developing roller. In the latter case, the image forming apparatus which is not provided with a cleaner mechanism may be referred to as a "cleanerless type" image forming apparatus". An example of this cleanerless type is disclosed in JP-3154757B2 (JP-5053482A).

The image forming apparatus of the cleanerless type is advantageous in that the size of the apparatus can be reduced in the absence of a cleaner mechanism for removing the remaining toner from the surface of the image carrier. However, the apparatus still suffers from difficulty to remove paper dust which tends to adhere to the surface of the image carrier during a transfer of the toner image from the image carrier to the recording medium. In the presence of the paper dust on the image carrier, the toner may adhere to the paper dust and may be transferred together with the paper dust to the recording medium, giving rise to a risk of undesirable formation of unintended colored spots (generally called "paper dust spots") on the recording medium.

That is, the paper dust produced by the recording medium in the form of paper sheets tends to adhere directly to the image carrier, or indirectly to the image carrier via the intermediate image transfer belt. In the image forming apparatus of the cleanerless type, the paper dust cannot be removed from the image carrier, leading to the risk of formation of the paper dust spots on the recording medium.

SUMMARY OF THE INVENTION

The present invention was made in view of the problems discussed above. It is therefore an object of the present invention to provide a multiple-color image forming apparatus of a cleanerless type, which is arranged to efficiently remove a dust from image carriers.

The above object may be achieved according to the principle of the present invention, which provides an image forming apparatus comprising a plurality of image forming units operable to form respective toner images of respective different colors on a toner-image receiving medium, each of the plurality of image forming units including (a) an image carrier, (b) a static-latent-image forming portion operable to form a static latent image on a surface of the image carrier, (c) a developing portion operable to apply a toner of a corresponding one of the different colors to the surface of the image carrier, according to the static latent image, for thereby forming the toner image of the corresponding color on the image carrier, and (d) a toner transferring portion operable to transfer the toner image from the image carrier to the toner-image receiving medium, the plurality of image forming units being disposed so as to be opposed to the toner-image receiving medium being fed in one direction, and operable to sequentially transfer the toner images from the image carriers to the toner-image receiving medium, wherein an improvement comprises:

the developing portion of each of the plurality of image forming units is operable to adsorb the toner remaining on the surface of the image carrier after the toner image formed last on the image carrier is transferred to the toner-image receiving medium; and each of at least one of the plurality of image forming units is provided with a dust removing portion operable to remove, from the surface of the image carrier, a dust which has been transferred to the surface of the image carrier during a transfer of the toner image from the image carrier to the toner-image receiving medium, the above-indicated at least one of the plurality of image forming units including the most upstream one of the image forming units which is located at the most upstream position of the image forming apparatus and which is operated to transfer the toner image to the toner-image receiving medium before each of the other of the plurality of image forming units is operated to transfer the toner image to the toner-image receiving medium.

In the image forming apparatus of the present invention constructed as described above, at least the most upstream image forming unit is provided with the dust removing portion, so that the amount of the dust adhering to the surface of the image carrier of each image forming portion is reduced to improve the quality of a toner image formed on the toner-image receiving medium and the quality of a toner image eventually formed on a recording medium, even in the absence of a cleaner mechanism arranged to scrape the surface of the image carrier for removing the dust.

In a first preferred form of the image forming apparatus of the invention, the dust removing portion is not provided for at least one of the plurality of image forming units, which includes the most downstream one of the image forming units which is located at the most downstream position of the image forming apparatus and which is operated to transfer the toner image to the toner-image receiving medium after each of the other of the plurality of image forming units is operated to transfer the toner image to the toner-image receiving medium. This arrangement is based on a fact that the amount of the dust to be removed by the dust removing portion of the relatively upstream image forming unit is larger than that to be removed by the dust removing portion of the relatively upstream image forming unit. The present arrangement is effective to reduce or prevent an adverse influence of the dust removing portion on the image carrier of the relatively downstream image forming unit or units not provided with the dust removing portion. Accordingly, each image forming unit not provided with the dust removing portion has an increased service life, and a reduced number of components, leading to a reduced size of the image forming apparatus as a whole.

In a second preferred form of the image forming apparatus of the invention, the plurality of image forming units comprise four image forming units operable to form respective toner images of respective yellow, magenta, cyan and black colors on the toner-image receiving medium, and the image forming unit operable to form the toner image of the yellow color is the most upstream one of the image forming units.

In the second preferred form of the image forming apparatus of the invention described above, the yellow toner image is first formed by the yellow image forming unit which is located at the most upstream position and which is most easily influenced by the dust transferred from the toner-image receiving medium. However, dust spots such as paper dust spots of the yellow color, if produced in the process of formation of the yellow toner image, are less likely to be perceived, so that the yellow toner image formed on the toner-image receiving medium is less likely to be deteriorated by the yellow dust spots even if they appear on the color image due to some small amount of the dust on the image carrier of the yellow image forming unit.

In a third preferred form of the image forming apparatus of the invention, the plurality of image forming units comprise an image forming unit operable to form a toner image of a black color, which is located at the most downstream position of the image forming unit and which is operated to transfer the toner image of the black toner to the toner-image receiving medium after each of the other of the plurality of image forming units is operated to transfer the toner image to the toner-image receiving medium.

The image forming unit operable to form the black toner image is used not only when the plurality of image forming units are operated to form a color image, but also when only the black image forming unit is operated to form a monochrome image, that is, a black image. According the frequency of use of the black image forming unit is considerably higher than those of the other image forming units, so that the service life of the image carrier of this black image forming unit tends to be shorter than those of the image carriers of the other image forming units. In the third preferred form of the image forming apparatus of the invention wherein the black image forming unit is located at the most downstream position, as described above, it is possible to reduce the dust removing capacity of the dust removing portion of the black image forming unit, with respect to those of the dust removing portions of the other image forming units, or to eliminate the dust removing portion for the black image forming unit, so that the influence of the dust removing portion on the image carrier of the black image forming unit can be reduced or prevented, whereby the service life of this image carrier can be increased.

In a fourth preferred form of the image forming apparatus of the invention, the plurality of image forming units comprise an image forming unit operable to form a toner image of a black color, which is the above-indicated most upstream one of the image forming units.

In the fourth preferred form of the image forming apparatus described above, the dust can be removed from the image carrier of the black image forming unit when only this black image forming unit is operated to form a monochrome image, namely, a black image. Accordingly, the black image can be efficiently formed with a high degree of quality.

In a fifth preferred form of the image forming apparatus, the dust removing portion comprises a base member and a brush of fibers planted in said base member. In a sixth preferred form the image forming apparatus, the dust removing portion comprises a non-woven fabric. The dust, such as paper dust, which is to be removed by the dust removing portion is generally amorphous, and can be relatively easily caught and removed by the fibers or non-woven fabric.

In a seventh preferred form of the image forming apparatus of the invention, the dust removing portion comprises an electrically conductive body, and a bias-voltage applying portion operable to apply a bias voltage between the electrically conductive body and the image carrier, to facilitate removal of the dust from the image carrier. In this respect, it is noted that the dust on the surface of the image carrier, such as a paper dust, has a polarity opposite to that of the image carrier which is electrostatically charged. Therefore, the application of the bias voltage to the electrically conductive body of the dust removing portion permits efficiency removal of the dust by electrostatic adsorption of the dust by the dust removing portion.

In a eighth preferred form of the image forming apparatus of the invention, the above-indicated at least one of the plurality of image forming units each of which is provided with the dust removing portion consists of the above-indicated most upstream one of the image forming units, and at least one downstream image forming unit which is located adjacent to and downstream of the most upstream one of the image forming units, and where the dust removing portions of the most upstream one of the image forming units and the above-indicated at least one downstream image forming units have dust removing capacities which are determined such that the dust removing capacity of the dust removing portion of one of two adjacent ones of the image forming units which is located downstream of the other of these two adjacent ones is not larger than that of the other of the two adjacent ones. In this eighth form of the image forming apparatus wherein all of the image forming units may be provided with the respective dust removing portions, the dust removing capacities of the image forming units may decrease in the downstream direction. In this case, the service life of the relatively downstream image forming unit or units each provided with the dust removing portion can be increased.

In a first advantageous arrangement of the eighth preferred form of the image forming apparatus, the dust removing portion of each of the most upstream image forming unit and the above-indicated at least one downstream image forming unit is held in contact with the surface of the image carrier, to remove the dust from the surface of the image carrier, and the dust removing portions of the most upstream image forming unit and the above-indicated at least one downstream image forming units have pressures of contact with the surfaces of the corresponding image carriers, which pressures of contact are determined such that the pressure of contact of the dust removing portion of the above-indicated downstream one of the two adjacent ones of the image forming units is not higher than that of the other of the two adjacent ones. In a second advantageous arrangement of the eighth preferred form of the image forming apparatus, the dust removing portion of each of the most upstream image forming unit and the above-indicated at least one downstream image forming unit is held in contact with the surface of the image carrier, to remove the dust from the surface of the image carrier, and the dust removing portions of said most upstream image forming unit and the above-indicated at least one downstream image forming units have dimensions of contact with the surfaces of the corresponding image carriers in a direction of movement of the surfaces, which dimensions of contact are determined such that the dimension of contact of the dust removing portion of the above-indicated downstream one of the two adjacent ones of the image forming units is not larger than that of the other of the two adjacent ones.

In a third advantageous arrangement of the eighth preferred form of the image forming apparatus, the dust removing portion of each of the most upstream image forming unit and the above-indicated at least one downstream image forming unit comprises a base member and a brush of fibers planted in the base member, and the brushes of fibers of the dust removing portions of the most upstream image forming unit and the above-indicated at least one downstream image forming units have densities which are determined such that the density of the brush of fibers of the dust removing portion of the above-indicated downstream one of the two adjacent ones of the image forming units is not higher than that of the other of the two adjacent ones.

In a fourth advantageous arrangement of the eighth preferred form of the image forming apparatus, the dust removing portion of each of the most upstream image forming unit and the above-indicated at least one downstream image forming unit comprises an electrically conductive body, and a bias-voltage applying portion operable to apply a bias voltage between the electrically conductive body and the image carrier, to facilitate removal of the dust from the image carrier, and the bias voltages applied by the bias-voltage applying portions of the dust removing portions of the most upstream image forming unit and the above-indicated at least one downstream image forming units are determined such that the bias voltage applied by the bias-voltage applying portion of the dust removing portion of the downstream one of the two adjacent ones of the image forming units is not higher than that of the other of the two adjacent ones.

In a fifth advantageous arrangement of the eighth preferred form of the image forming apparatus, the dust removing portion of each of the most upstream image forming unit and the above-indicated at least one downstream image forming unit comprises a dust container for storing the dust removed from said image carrier, and the dust removing portions of the most upstream image forming unit and the above-indicated at least one downstream image forming units have storage capacities which are determined such that the storage capacity of the dust container of the dust removing portion of the above-indicated downstream one of the two adjacent ones of the image forming units is not larger than that of the other of the two adjacent ones.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF THE PREFERRED EMBODIMENT

Figure 1:
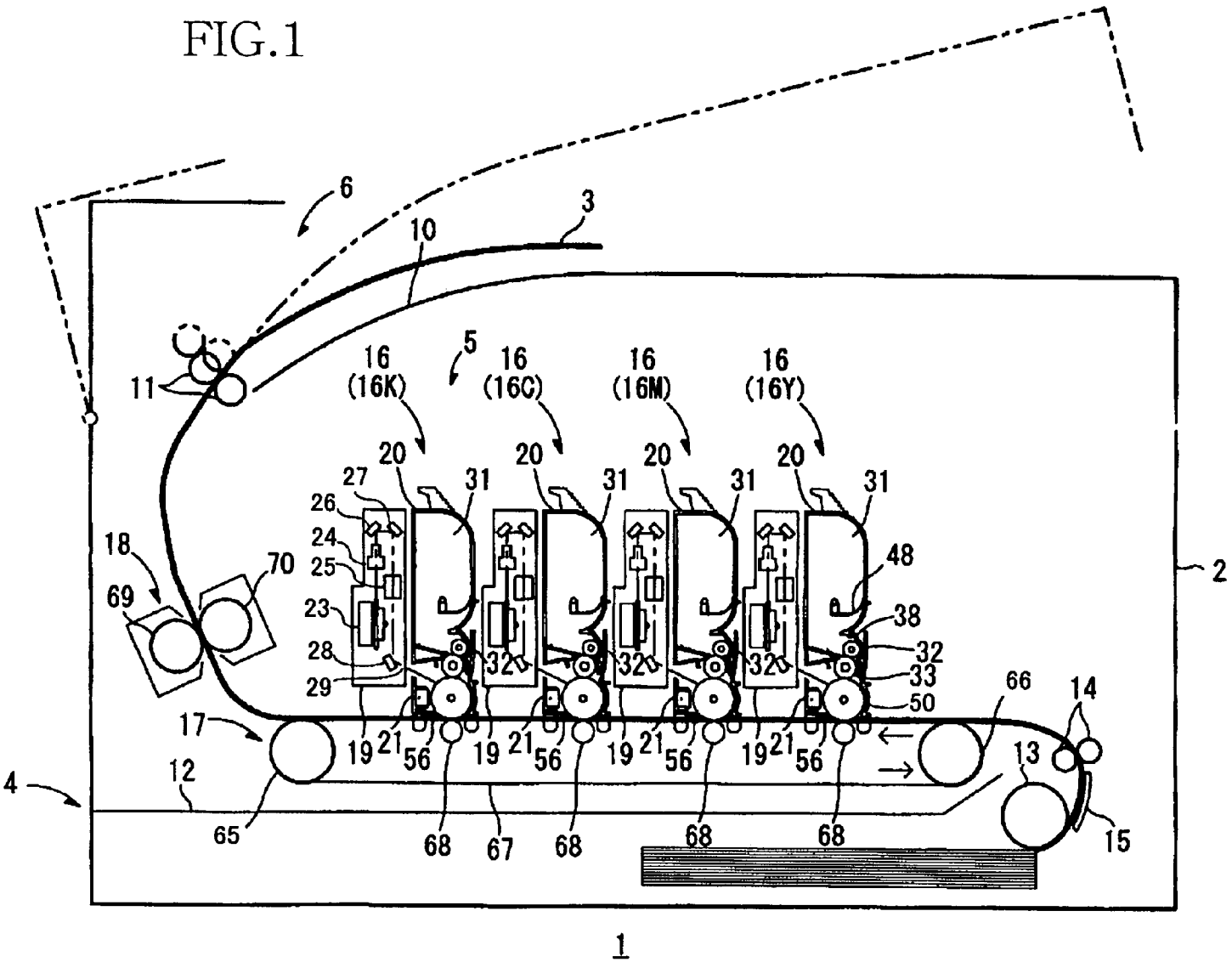
FIG. 1 is an elevational view in cross section showing a basic arrangement of a color laser printer constructed according to a first embodiment of this invention.
Figure 2:
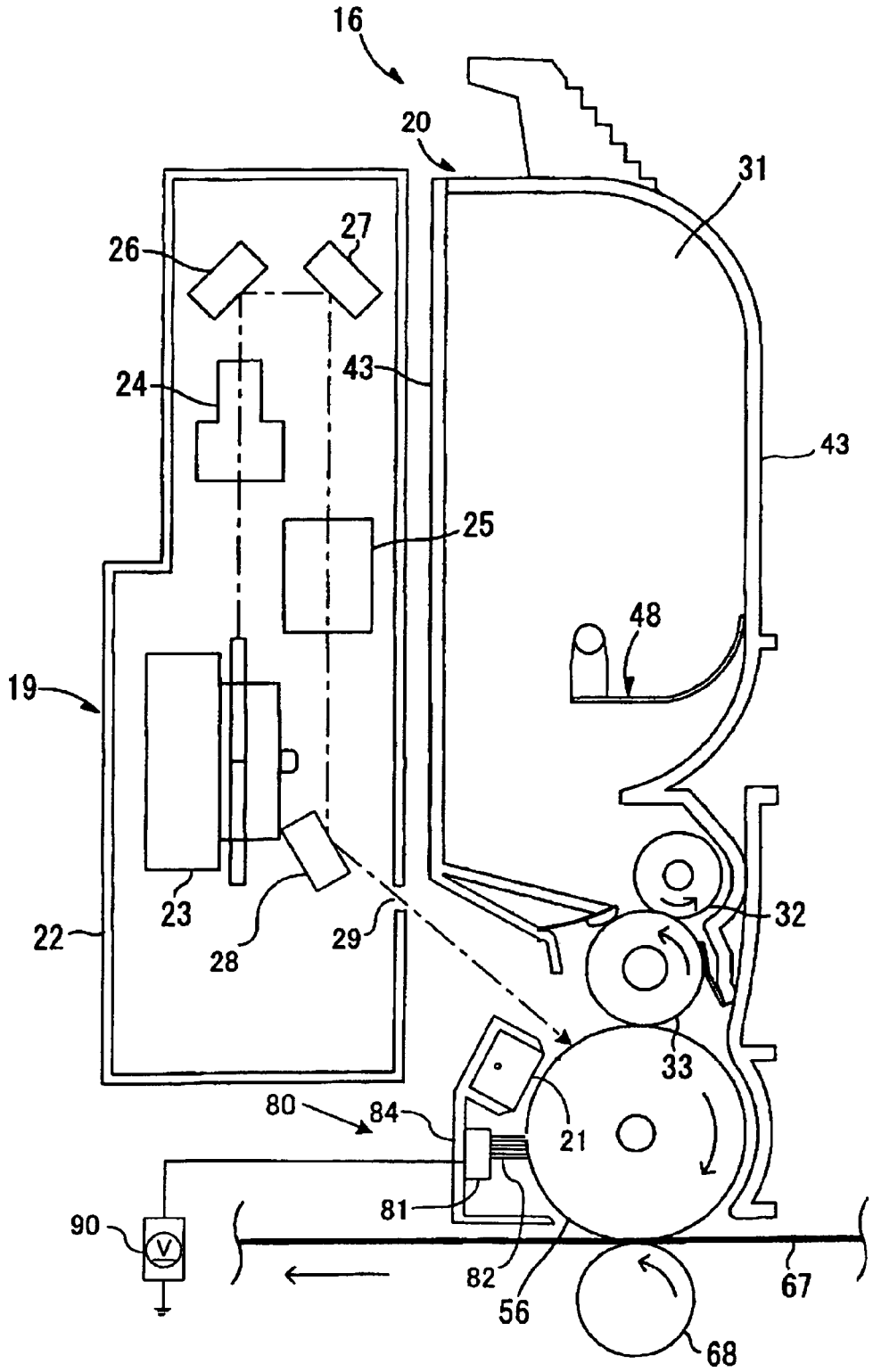
FIG. 2 is an enlarged elevational view showing in detail one of four image forming units of the color laser printer of FIG. 1.
Figure 3:
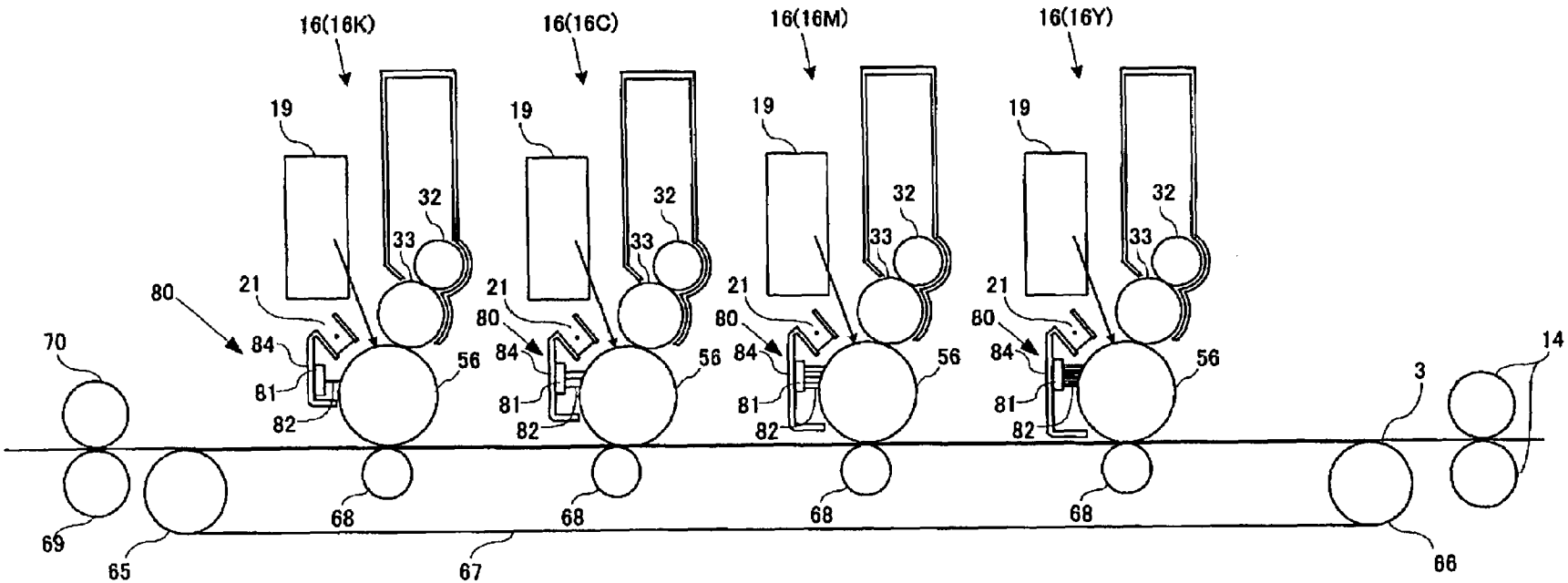
FIG. 3 is an elevational view for explaining a decrease in the density of fibers of brushes of paper dust removing devices of the four image forming units, to reduce the paper dust removing capacities of the units of the color laser printer of FIG. 1 in a feeding direction of a paper sheet.

Referring first to FIGS. 1–3, a basic arrangement of a color laser printer 1 constructed according to a first embodiment of the present invention will be described. As shown in FIG. 1, the present color laser printer 1 has a main body 2, which houses a paper supplying portion 4 arranged to supply a recording medium in the form of sheets of paper 3, an image forming portion 5 arranged to form a color image on the paper sheets 3 supplied from the paper supplying portion 4, and a paper ejecting portion 6 arranged to eject the paper sheets 3 on which the color image has been formed by the image forming portion 5. The image forming portion 5 includes four image forming units 16 which are arranged in tandem in the horizontal direction.

The paper supplying portion 4 includes a paper supply tray 12, a paper supply roller 13, and a pair of paper feed rollers 14. The paper supply tray 12 is removably installed in the bottom portion of the main body 2, such that the paper supply tray 12 can be inserted into and removed from the main body 2 through an opening provided at the front end portion of the main body 2. The paper supply roller 13 is located adjacent to the front and upper end of the paper supply tray 12, and the paper feed rollers 14 are located above the paper supply roller 13, and downstream of the paper supply roller 13 as viewed in a direction of feeding of the paper sheets 3 from the paper supply tray 12.

The paper supply tray 12 is arranged to accommodate a stack of the paper sheets 3 such that the uppermost paper sheet 3 of the stack is supplied from the paper supply tray 12 to the paper feed rollers 14, by rotation of the paper supply roller 13. The feed rollers 14 advance the paper sheet 3 onto a conveyor belt 67.

Between the paper supply roller 13 and the paper feed rollers 14, there is provided a guide member 15 which extends in an almost vertical direction and which is arranged to guide the paper sheets 3 successively supplied from the paper supply tray 12 by the paper supply roller 13, to a nip between the two paper feed rollers 14.

Each of the four image forming units 16 of the image forming portion 5 includes an image carrier in the form of a photoconductive or photosensitive drum 56, and components disposed around or adjacent to the outer circumference of the photosensitive drum 56. These components include a charger 21, a static-latent-image forming portion in the form of a scanner unit 19, and a developing portion in the form of a developing unit 20. The charger 21 is arranged to electrostatically charge the outer circumferential surface of the photosensitive drum 56, and the scanner unit 19 is arranged to form a static latent image on the outer circumferential surface of the photosensitive drum 56. The developing unit 20 is arranged to apply a developing material in the form of a toner to the outer circumferential surface of the photosensitive drum 56, for thereby forming a toner image on the photosensitive drum 56.

The photosensitive drum 56 is a hollow cylindrical body consisting of an aluminum cylindrical sleeve having an outer circumferential surface on which a photoconductive layer is formed of an organic photosensitive composition a major component of which is a positively chargeable material such as a positively chargeable polycarbonate. The photosensitive drum 56 is rotatably supported by the main body 2, with its cylindrical sleeve being grounded.

The charger 21 is a scorotron type charger including charging wires formed of tungsten, for example, which are energized to effect a corona discharge for positively charging the photoconductive layer of the photosensitive drum 56 evenly or uniformly over its entire surface.

The scanner unit 19 has a scanner casing 22 in the form of a generally box construction, and includes a laser generator (not shown), a polygon mirror 23, a pair of lenses 24, 25 and three reflecting mirrors 26, 27, 28, which are housed within the scanner casing 22. The laser generator is arranged to generate a laser radiation for forming a static latent image on the outer circumferential surface of the photosensitive drum 56.

In operation of the scanner unit 19, the laser radiation (indicated by one-dot chain line in FIG. 2) generated by the laser generator is reflected by the polygon mirror 23, and the reflected laser radiation is transmitted through the lens 24, reflected by the reflecting mirrors 26 and 27, transmitted through the lens 25 and reflected by the reflecting mirror 28. The laser radiation reflected by the mirror 28 is emitted out of the scanner casing 22 through an emission window 29. The outer circumferential surface of the photosensitive drum 56 is scanned according to image data, by irradiation with the laser radiation emitted through the emission window 29, so that a static latent image is formed on the surface of the photosensitive drum 56.

The developing unit 20 has a developer casing 43, and includes a toner container in the form of a toner hopper 31, a toner supplying portion in the form of a toner supply roller 32, and a toner carrier in the form of a developing roller 33, which are housed within the developer casing 43.

The toner hopper 31 is defined by the developer casing 43, as an interior space within the casing 43. Within the toner hopper 31, there is disposed an agitator 48. The toner hopper 31 of each image forming unit 16 accommodate a toner of the corresponding color, that is, a yellow (Y), magenta (M), cyan (C), or black (K) toner.

Described more specifically, the four image forming units 16 consist of a yellow image forming unit 16Y provided with the toner hopper 31 accommodating the yellow (Y) toner, a magenta image forming unit 16M provided with the toner hopper 31 accommodating the magenta (M) toner, a cyan image forming unit 16C provided with the toner hopper 31 accommodating the cyan (C) toner, and a black image forming unit 16K provided with the toner hopper 31 accommodating the black (K) toner.

The toner accommodated in the toner hopper 31 is a one-component type positively chargeable non-magnetic developing agent, which is produced by suspension polymerization or emulsion polymerization. This developing agent is a powder consisting of generally spherical fine particles and having an extremely high degree of fluidity.

The toner supply roller 32 is located in a lower portion of the toner hopper 31, and consists of a metallic shaft portion and a roller portion which is formed, on the shaft portion, of an electrically conductive spongy material. This toner supply roller 32 and the developing roller 33 are disposed adjacent to each other so as to define a nip therebetween, and are rotatably supported by the casing 43 such that the two rollers 32, 33 are rotatable in the opposite directions.

The developing roller 33, which is located under the toner supply roller 32 and held in rolling contact with the roller 32, consists of a metallic shaft portion and a roller portion which is formed, on the shaft portion, of an electrically conductive elastic material such as an electrically conductive rubber material.

The toner transferring portion 17, which is also housed within the main body 2, is located on side of the photosensitive drum 56 which is opposite to the developing unit 20 diametrically of the photosensitive drum 56. Thus, each image forming unit 16 is disposed so as to be opposed to the paper sheet 3 which is fed together with the conveyor belt 67. The toner transferring portion 17 includes a drive roller 65, a driven roller 66, an endless conveyor belt 67, and a toner transfer roller 68.

The driven roller 66 is located frontwards of the photosensitive drum 56 of the yellow image forming unit 16Y which is the most upstream image forming unit as viewed in the direction of feeding of the paper sheets 3. Further, the driven roller 66 is located upwards and rearwards of the paper supply roller 13. On the other hand, the drive roller 65 is located rearwards of the photosensitive drum 56 of the black image forming unit 16K which is the most downstream image forming unit as viewed in the feeding direction of the paper sheets 3. Further, the drive roller is located obliquely downwards and frontwards of the image fixing portion 18.

The conveyor belt 67 is formed of a resinous material such as polycarbonate or polyimide, which contains an electrically conductive powder such as a carbon powder such that the electrically conductive powder is evenly dispersed within the resinous material. The conveyor belt 67 connects the drive roller 65 and the driven roller 66 such that the outer surface of an upper span of the conveyor belt 67 between the drive and driven rollers 65, 66 is held in contact with the photosensitive drums 56 of the four image forming units 16.

The driven roller 66 and the conveyor belt 67 are rotated by the drive roller 65 in the counterclockwise direction such that the above-indicated outer surface of the upper span of the conveyor belt 67 between the drive and driven rollers 65, 66 is held in contact with the photosensitive drums 56 of the image forming units 16 while the photosensitive drums 56 are rotated in the clockwise direction.

The toner transfer roller 68 is located within the conveyor belt 67, such that the toner transfer roller 68 cooperates with the photosensitive drum 56 of each image forming unit 16 to define a nip therebetween. This toner transfer roller 68 consists of a metallic shaft portion and a roller portion which is formed, on the shaft portion, of an electrically conductive elastic material such as an electrically conductive rubber material.

The toner transfer roller 68 is supported such that the roller 68 is rotatable in the counterclockwise direction, in rolling contact with an inner surface of the upper span of the conveyor belt 67 rotated in the counterclockwise direction. In operation of the color laser printer 1, the paper sheet 3 supported by the conveyor belt 67 is passed through the nip between each photosensitive drum 56 and the corresponding toner transfer roller 68, and a predetermined image-transfer bias voltage is applied between the toner transfer roller 68 and the photosensitive drum 56, in a direction that permits the toner image to be transferred from the photosensitive drum 56 onto the paper sheet 3 on the conveyor belt 67, when the paper sheet 3 is passed through the above-indicated nip.

The image fixing portion 18 is located rearwards and downstream of the image forming units 16 and the toner transferring portion 17, and includes a presser roller 69 and a heater roller 70. The heater roller 70 consists of a metallic tube which has an outer circumferential surface coated with a releasing layer and which incorporates a halogen lamp extending in the axial direction. With the halogen lamp being energized, the heater roller 70 is heated to a predetermined image fixing temperature at its releasing layer. The presser roller 69 cooperates with the heater roller 70 to define a pressure nip therebetween.

The pair of paper ejector rollers 11 is located downstream of the image fixing portion 18, and the paper ejector tray 10 is located downstream of the paper ejector rollers 11. In the present color laser printer 1, a portion of the toner not forming the toner image does not remain on the photosensitive drum 56 of each image forming unit 16, but is held adsorbed on the surface of the developing roller 33. That is, each image forming unit 16 of the present laser printer 1 is of the so-called "cleanerless type" without a cleaner mechanism.

Described in detail, the outer circumferential surface of the photosensitive drum 56 on which a given amount of the toner remains after the transfer of the last toner image to the paper sheet 3 is uniformly charged by the charger 21 of scorotron type at a predetermined charging position as the photosensitive drum 56 is rotated. At a predetermined exposing position, the surface of the photosensitive drum 56 is locally selectively or imagewise exposed to the laser radiation emitted from the scanner unit 19. A portion of the toner remaining in the non-exposed local areas of the photosensitive drum 56 is adsorbed onto the developing roller 33 the static polarity of which is opposite to that of the non-exposed portions. On the other hand, a portion of the toner remaining in the exposed local areas of the photosensitive drum 56 and a portion of the toner transferred from the developing roller 33 remain on the exposed local areas, and cooperate to form a toner image.

In operation of the color laser printer 1 constructed as described above, the outer circumferential surface (photoconductive layer) of the photosensitive drum 56 of each image forming unit 16 is uniformly electrostatically charged by the charger 21, and is imagewise exposed to the laser radiation (indicated by the one-dot chain line in FIG. 2) which is emitted from the scanner unit 19 and modulated according to the image data, so that a static latent image is formed on the surface of the photosensitive drum 56. This static latent image is developed by the developing unit 20 into a visible toner image of the corresponding color, with the toner being transferred from the developing roller 33 to the exposed local areas of the photosensitive drum 56.

At a predetermined toner transferring position, the visible toner image is transferred from the photosensitive drum 56 onto the paper sheet 3, by application of the bias voltage between the toner transfer roller 68 and the photosensitive drum 56, when the paper sheet 3 supplied from the paper supply tray 12 and fed by the paper feed roller 14 is passed together with the upper span of the conveyor belt 67, through the nip between the photosensitive drum 56 and the toner transfer roller 68. A color image is formed on the paper sheet 3, as a result of transfer of the four toner images of the respective four colors (Y, M, C, K) from the four image forming units 16Y, 16M, 16C and 16K.

The paper sheet 3 is further advanced to the image fixing portion 18, and passed through the nip between the presser roller 69 and the heater roller 70, so that the visible toner image on the paper sheet 3 is heated and pressed onto the paper sheet 3, whereby the toner image is fixed on the paper sheet 3. The paper sheet 3 is further advanced by the paper ejector rollers 11 into the paper ejector tray 10.

The toner remaining on the photosensitive drum 56 is removed from the drum 56 by the developing unit 20, and re-used for developing the next latent image into a visible toner image. Thus, the present color laser printer 1 is not provided a cleaner mechanism for scraping off the toner remaining on the photosensitive drum 56, and does not require a waste toner container which would be required to accommodate the toner removed by the cleaner mechanism. Accordingly, the present laser printer 1 can be made small-sized, and the toner can be used with a relatively high ratio of utilization.

Thus, the toner remaining on the photosensitive drum 56 of each image forming unit 16 can be removed by the developing roller 33 of the developing unit 20 and returned back to the developing roller 33. The present laser printer 1 is further required to remove paper dust which may be transferred from the paper sheet 3 to the photosensitive drum 56 during the transfer of the visible toner image from the drum 56 to the paper sheet 3.

To meet the above-described requirement, each image forming unit 16 is provided with a dust removing portion in the form of a paper dust removing device 80, as shown in FIG. 2. The paper dust removing device 80 is arranged to remove, from the photosensitive drum 56, the paper dust which has been transferred from the paper sheet 3.

As shown in FIG. 2, the paper dust removing device 80 includes a paper dust container 84 which is L-shaped in cross section so as to cover a left lower portion of the outer circumference of the photosensitive drum 56, and to store or accommodate the paper dust removed from the photosensitive drum 56. The paper dust removing device 80 further includes a base member 81 fixed to the paper dust container 84 such that the base member 81 faces an upper part of the above-indicated left lower portion of the outer circumferential surface of the photosensitive drum 56. The base member 81 carries a brush of electrically conductive fibers 82. The paper dust removing device 80 further includes a constant-voltage source 90 provided to apply a bias voltage to the base member 81 and the brush of fibers 82.

The fibers 82 are planted in the base member 81 such that the fibers 82 are held in pressing contact with the outer circumferential surface of the photosensitive drum 56, so that the brush of fibers 82 scrapes the paper dust off the surface of the photosensitive drum 56 during rotation of the drum 56.

The constant-voltage source 90 is arranged to apply, between the base member 81 (brush of fibers 82) and the photosensitive drum 56, a bias voltage the polarity of which is opposite to that of the paper dust, such that the paper dust is removed from the photosensitive drum 56 and adsorbed by the fibers 82.

In the present first embodiment, the yellow (Y), magenta (M), cyan (C) and black (K) image forming units 16Y, 16M, 16C and 16K are arranged in this order of description along a feeding path of the paper sheet 3, in the feeding direction of the paper sheet 3, as shown in FIG. 3. The paper dust removing devices 80 of the four image forming unit 16 are arranged such that the density of the fibers 82 of the paper dust removing devices 80 of the four image forming units 16 decreases in the feeding direction of the paper sheet 3, to reduce the paper dust removing capacities of the paper dust removing devices 80 in the feeding direction, so that the paper dust removing device 80 of the yellow image forming unit 16Y has the highest density of the fibers 82, while that of the black image forming unit 16K has the lowest density. Further, the volume or storage capacity of the paper dust containers 84 of the paper dust removing devices 80 of the four image forming devices 16 decreases in the feeding direction of the paper sheet 3 as the density of the fibers 82 decreases in the feeding direction.

In the color laser printer 1 according to the present first embodiment of this invention, the four image forming units 16Y, 16M, 16C and 16K for forming the respective toner images of yellow, magenta, cyan and black colors are provided with the respective paper dust removing devices 80 which are arranged to remove the paper dust from the photosensitive drums 56, even if the paper dust is transferred from the paper sheet 3 to the photosensitive drums 56.

Accordingly, the present color laser printer 1 having the image forming units 16 of the cleanerless type permits an improved quality of a visible color image printed on the paper sheet 3, without deterioration of the image quality due to the paper dust spots.

Further, the paper dust removing devices 80 provided for the respective image forming units 16 are arranged such that the density of the fibers 82 planted in the base members 81 of the four paper dust removing devices 80 decreases in the feeding direction of the paper sheet 3, such that the brush of fibers 82 of the paper dust removing device 80 of a downstream one of the two adjacent image forming units 16 has a lower density of the fibers 82 than that of the paper dust removing device 80 of the other unit 16. Further, the dimension of contact of the brushes of fibers 82 with the photosensitive drums 56 in the rotating direction of the drums 56 also decreases in the feeding direction of the paper sheet 3, such that the brush of fibers 82 of the device 80 of the most upstream image forming unit 16Y has the largest dimension of contact, while that of the most downstream image forming unit 16K has the smallest dimension of contact. In this case, the device 80 of the most upstream image forming unit 16Y has the largest number of the fibers 82, while that of the most downstream image forming units 16K has the smallest number of the fibers 82.

The density and dimension of contact of the brushes of fibers 82 of the paper dust removing devices 80 are reduced in the feeding direction of the paper sheet 3, to reduce the paper dust removing capacities of the devices 80 in the feeding direction, since the amount of the paper dust which is transferred from the paper sheet 3 to the photosensitive drum 56 of the most upstream image forming unit 16Y is the largest so that the amount of the paper dust removed from the photosensitive drum 56 of the most upstream unit 16Y is the largest, while on the other hand, the amount of the paper dust transferred to and removed from the photosensitive drum 56 of the relatively downstream unit 16M, 16C is smaller, and the amount of the paper dust transferred to and removed from the photosensitive drum 56 of the most downstream unit 16K is the smallest. Accordingly, the pressures of contact of the brushes of fibers 82 with the photosensitive drums 56 are lowered in the feeding direction of the paper sheet 3, whereby the degrees of deterioration of the photosensitive drums 56 are reduced in the feeding direction, so that the photosensitive drums 56 of the relatively downstream image forming units 16 have a relatively long service life.

It is noted that the paper dust transferred from the paper sheet 3 would have the largest influence on the yellow image forming unit 16Y which is the most upstream unit 16 as viewed in the feeding direction of the paper sheet 3. However, the paper dust spots of the yellow (Y) color are less likely to be perceived than the paper dust spots of the other colors, magenta (M), cyan (C) and black (K). Therefore, the color image formed on the paper sheet 3 is less likely to be deteriorated by the yellow paper dust spots even if they appear on the color image due to some small amount of the paper dust on the photosensitive drum 56 of the yellow image forming unit 16Y.

In this respect, the paper dust removing device 80 of the yellow image forming unit 16Y need not have an extremely large paper dust removing capacity to assure complete removal of the paper dust from the corresponding photosensitive drum 56. Accordingly, the service life of this photosensitive drum 56 can be improved.

In the present embodiment, the paper dust is removed by not only the contact of the brush of fibers 82 with the photosensitive drum 56, but also the application of a bias voltage from the constant-voltage source 90 to the brush of fibers 82. This arrangement ensures a high degree of stability of removal of the paper dust by the paper dust removing device 80.

Accordingly, the paper dust removing capacity of the paper dust removing device 80 can be adjusted by controlling the bias voltage to be applied from the constant-voltage source 90 to the brush of fibers 82, as well as the contact pressure of the brush of fibers 82 with respect to the photosensitive drum 56.

Namely, the required pressure of contact of the brush of fibers 82 with the photosensitive drum 56 can be reduced by increasing the bias voltage to be applied to the brush of fibers 82, while maintaining the required paper dust removing capacity of the paper dust removing device 80. In this respect, too, the service life of the photosensitive drum 56 can be increased.

Figure 4:
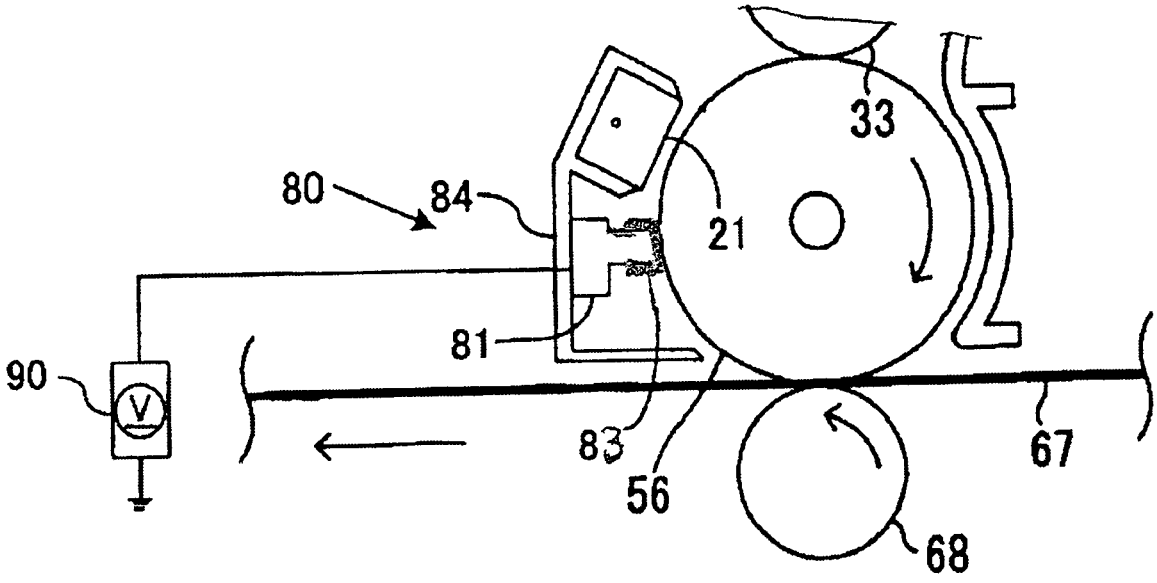
FIG. 4 is a fragmentary elevational view showing a modification of the paper dust removing device shown in FIG. 3.

While the first embodiment of the present invention has been described in detail, it is to be understood that the invention is not limited to the illustrated first embodiment, but may be embodied with various changes and modifications. For instance, the brush of fibers 82 planted in the base member 81 of the paper dust removing device 80 may be replaced by an unwoven fabric 83, as shown in FIG. 4.

The non-woven fabric 83 employed for the modified paper dust removing device is preferably mixed with an electrically conductive material, so that the paper dust can be adsorbed by the non-woven fabric 83 by application of a bias voltage from the constant-voltage source 90 to the non-woven fabric. Although the first embodiment is arranged such that both the density and the dimension of contact of the brushes of fibers 82 of the paper removing devices 80 of the four image forming units 16 are reduced in the feeding direction of the paper sheet 3 from the upstream side to the downstream side, only one of the density and the dimension of contact of the brushes of fibers 82 with the photosensitive drums 56 in the rotating direction of the drums 56 (in the direction of movement of the surfaces of the drums 56) may be reduced in the feeding direction of the paper sheet 3. In this case where the devices 80 have the different densities and the same dimension of contact, or the different dimensions of contact and the same density, the device 80 of the most upstream image forming unit 16Y having the highest density or dimension of contact has the largest number of the fibers 82, while that of the most downstream image forming units 16K having the lowest density has the smallest number of the fibers 82.

Figure 5:
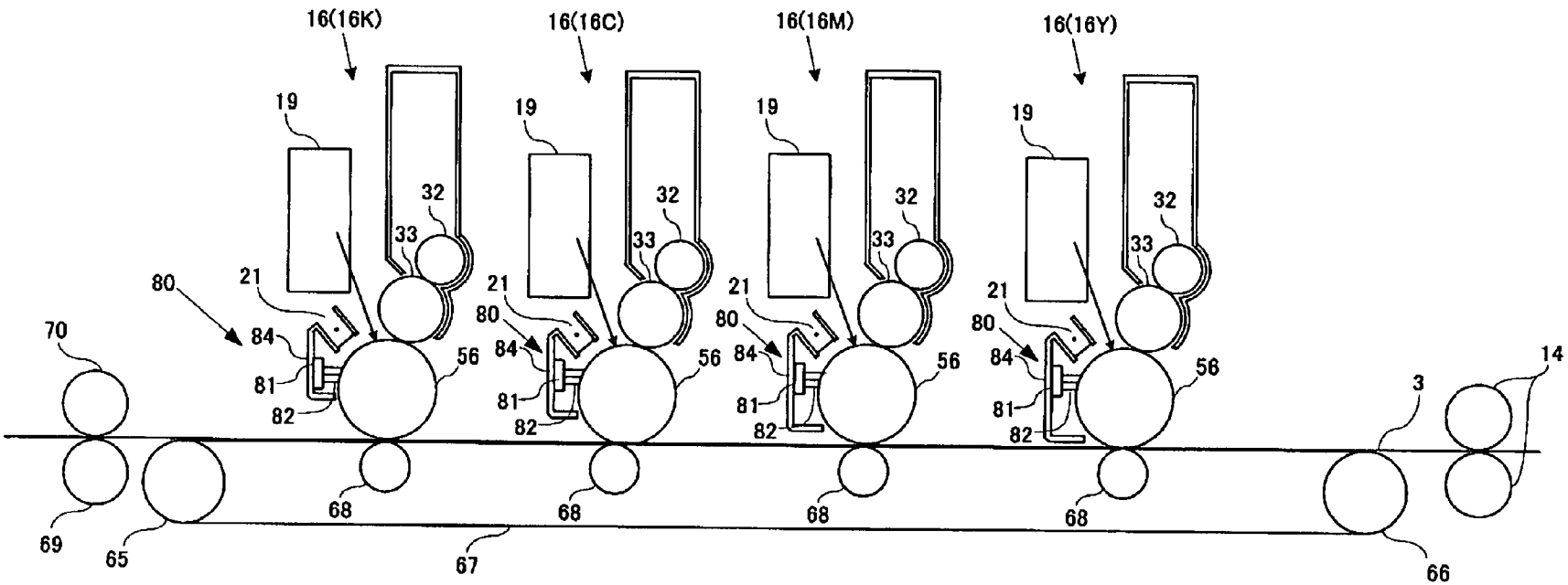
FIG. 5 is an elevational view corresponding to that of FIG. 3, showing a color laser printer according to a second embodiment of this invention wherein the brushes of the four paper dust removing devices have the same density of fibers, and the paper dust removing capacities of the four image forming units are reduced in the feeding direction of the paper sheet by reducing the bias voltage to be applied to the brushes, in the feeding direction.

Referring next to FIG. 5, there will be described a color laser printer constructed according to a second embodiment of the present invention, wherein the brushes of fibers 82 of the paper dust removing devices 80 of the four image forming units 16 have the same density, and the same dimension of contact with the photosensitive drums 56, but the bias voltage to be applied to the brushes of fibers 82 of the paper dust removing devices 80 of the image forming units 16 is reduced in the feeding direction of the paper sheet 3, to reduce the paper dust removing capacity of the paper dust removing devices 80, for increasing the service life of the photosensitive drums 56 of the relatively downstream image forming units 16M, 16C, 16K.

In the second embodiment described above, the amounts of removal of the paper dust from the photosensitive drums 56 of the relatively upstream image forming units 16Y, 16M are relatively large owing to the application of the relatively high bias voltage to the brushes of fibers 82 of the paper dust removing devices 80 of those relatively upstream image forming units. Further, the service life of the photosensitive drums 56 of the relatively downstream image forming units 16C, 16K can be increased owing to the application of the relatively low bias voltage to the brushes of fibers 82 of the paper dust removing devices 80 of those relatively downstream image forming units.

Figure 6:
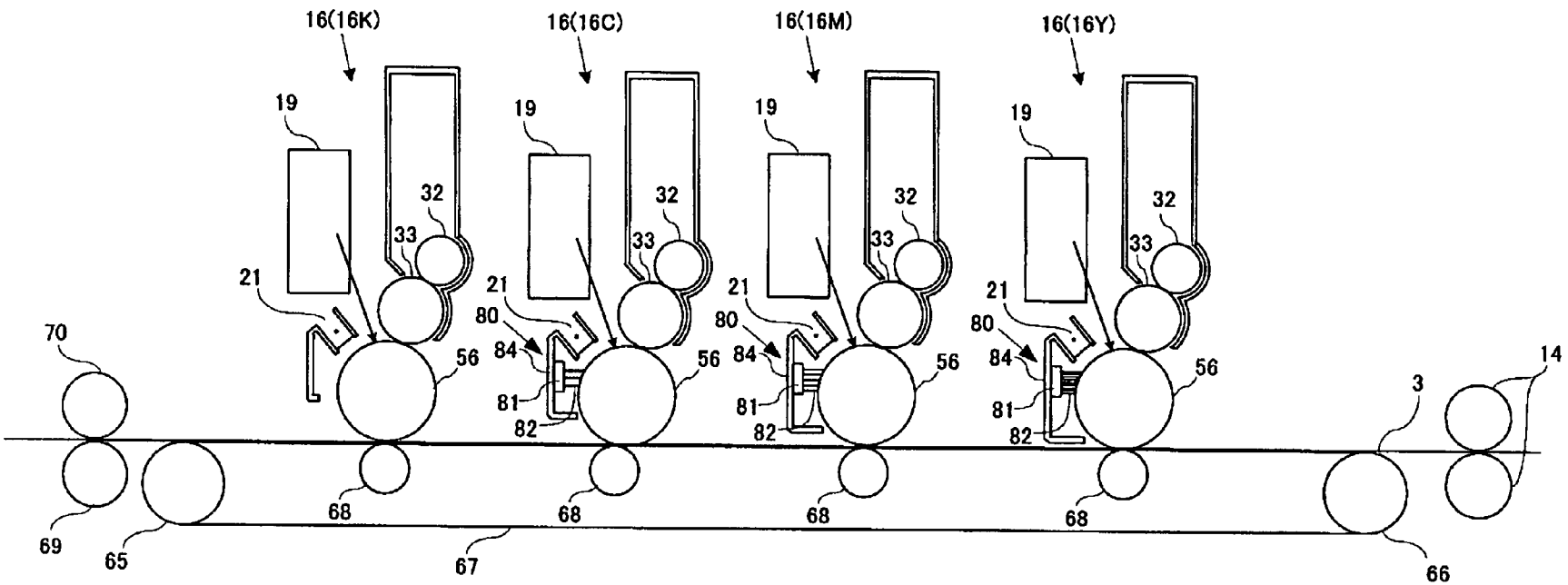
FIG. 6 is an elevational view corresponding to that of FIG. 3, showing a color laser printer according to a third embodiment of this invention wherein the most downstream image forming unit is not provided with the paper dust removing device.

FIG. 6 shows a color laser printer constructed according to a third embodiment of this invention, which is different from the color laser printer 1 of the first embodiment, in that each of the yellow, magenta and cyan image forming units 16Y, 16M and 16C is provided with the paper dust removing device 80, but the most downstream image forming unit, that is, the black image forming unit 16K is not provided with the paper dust removing device 80, in the third embodiment.

In the third embodiment, therefore, the paper dust is removed from the photosensitive drums 56 of the first three image forming units 16Y, 16M and 16C as counted from the most upstream unit 16Y, and the photosensitive drum 56 of the fourth or most downstream image forming unit 16K which is not provided with the paper dust removing device 80 is free from a contact pressure which would receive from the device 80 if provided for the unit 16K, so that the service life of the photosensitive drum 56 of the unit 16K can be increased.

The color laser printer according to the third embodiment of FIG. 6 is further advantageous in that the fourth image forming unit 16 which is not provided with the paper dust removing device 80 is the black image forming unit 16K which is generally operated most frequently and tends to have a comparatively short service life. In this respect, the elimination of the paper dust removing device 80 for this black image forming unit 16K results in an increase in its service life, and a consequent saving of the cost of maintenance of the color laser printer.

In the color laser printers of the first, second and third embodiments of FIGS. 3–6, a monochrome printing operation by only the black image forming unit 16K is usually performed while the photosensitive drums 56 of the other yellow, magenta and cyan image forming units 16Y, 16M and 16C which are not in operation are held apart from the conveyor belt 67 (paper sheet 3). In the monochrome printing operation, it is preferable to hold the photosensitive drum 56 of one of those yellow, magenta and cyan image forming units 16Y, 16M, 16C in contact with the paper sheet 3 on the conveyor belt 67, so that the paper dust is removed through this photosensitive drum 56, before the monochrome printing operation is performed by the black image forming unit 16K. This arrangement assures an improved quality of a black image formed on the paper sheet 3. Where the paper dust removing devices 80 of the three image forming units 16Y, 16M and 16C have the same paper dust removing capacities, the photosensitive drum 56 of any desired one of those three units 16Y, 16M, 16C is held in contact with the paper sheet 3. Where the paper dust removing devices 80 of those three image forming units have different paper removing capacities, the photosensitive drum 56 of the relatively upstream image forming unit 16Y or 16C having the relatively large paper dust removing capacity is preferably held in contact with the paper sheet 3. In the former case in which the photosensitive drum 56 of any desired one of the three units 16Y, 16M, 16C having the same paper dust removing capacity is held in contact with the paper sheet 3, it is preferable to alternately bring the photosensitive drums 56 of those units 16Y, 16M, 16C into contact with the paper sheet 3, in the monochrome printing operations, so that the overall service life of the color laser printer can be increased, with all of the image forming units 16 having almost equal service lives.

Figure 7:
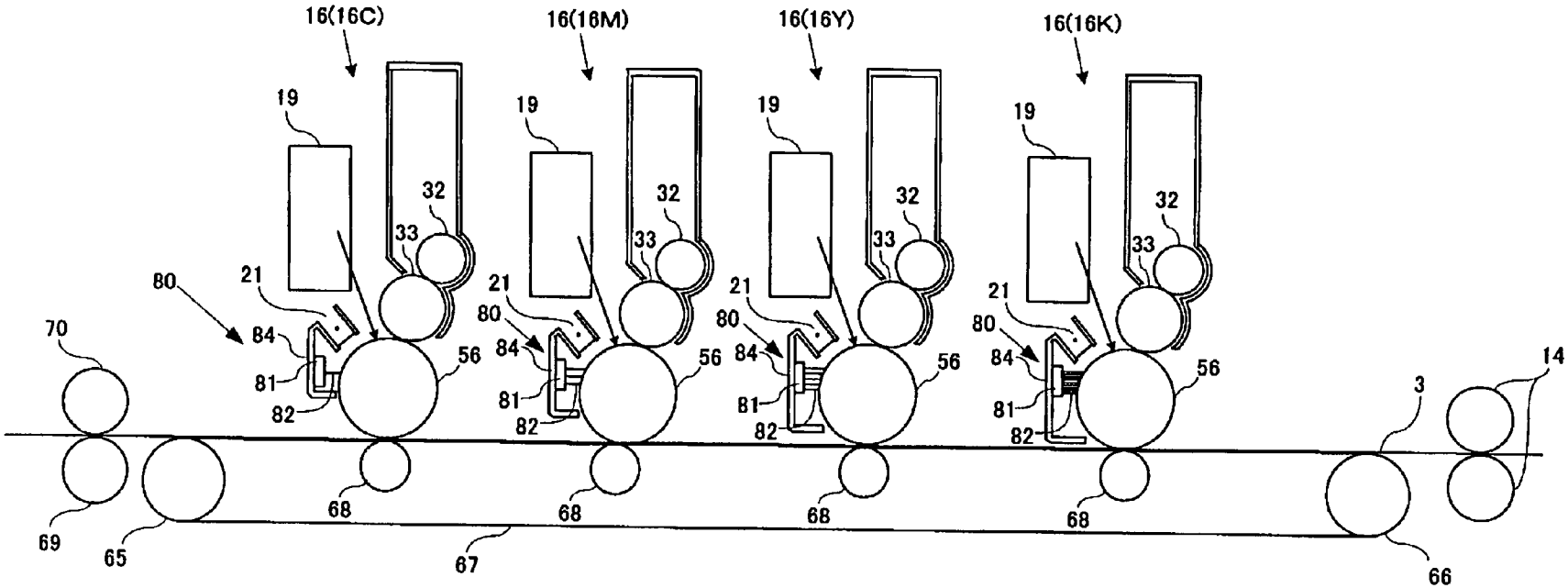
FIG. 7 is an elevational view corresponding to that of FIG. 3, showing a color laser printer according to a fourth embodiment of this invention wherein the black image forming unit is provided as the most upstream unit.

Reference is now made to FIG. 7 showing a color laser printer according to a fourth embodiment of the present invention, which is different from the color laser printers of the first, second and third embodiments, in that the black image forming unit 16K is provided as the first image forming unit as counted in the feeding direction of the paper sheet 3, that is, located at the most upstream position, in the fourth embodiment.

In the color laser printer of the fourth embodiment of FIG. 7, the paper dust removing device 80 of the black image forming unit 16K has the highest density of the brush of fibers 82, of the paper dust removing devices 80 of all of the four image forming units 16. This arrangement permits a monochrome printing operation with an improved quality of a black image, with an operation of the paper dust removing device 80 of the black image forming unit 16K, even while the photosensitive drums 56 of the other image forming units 16Y, 16M, 16C are held apart from the paper sheet 3.

In the fourth embodiment, the yellow image forming unit 16Y is provided as the second image forming unit located adjacent to the first or most upstream black image forming unit 16K. As described above with respect to the first embodiment, the yellow paper dust spots are less likely to deteriorate the color image, so that the yellow image forming unit 16Y provided as the second image forming unit assures a comparatively high quality of the color image formed by the four image forming units 16.

Figure 8:
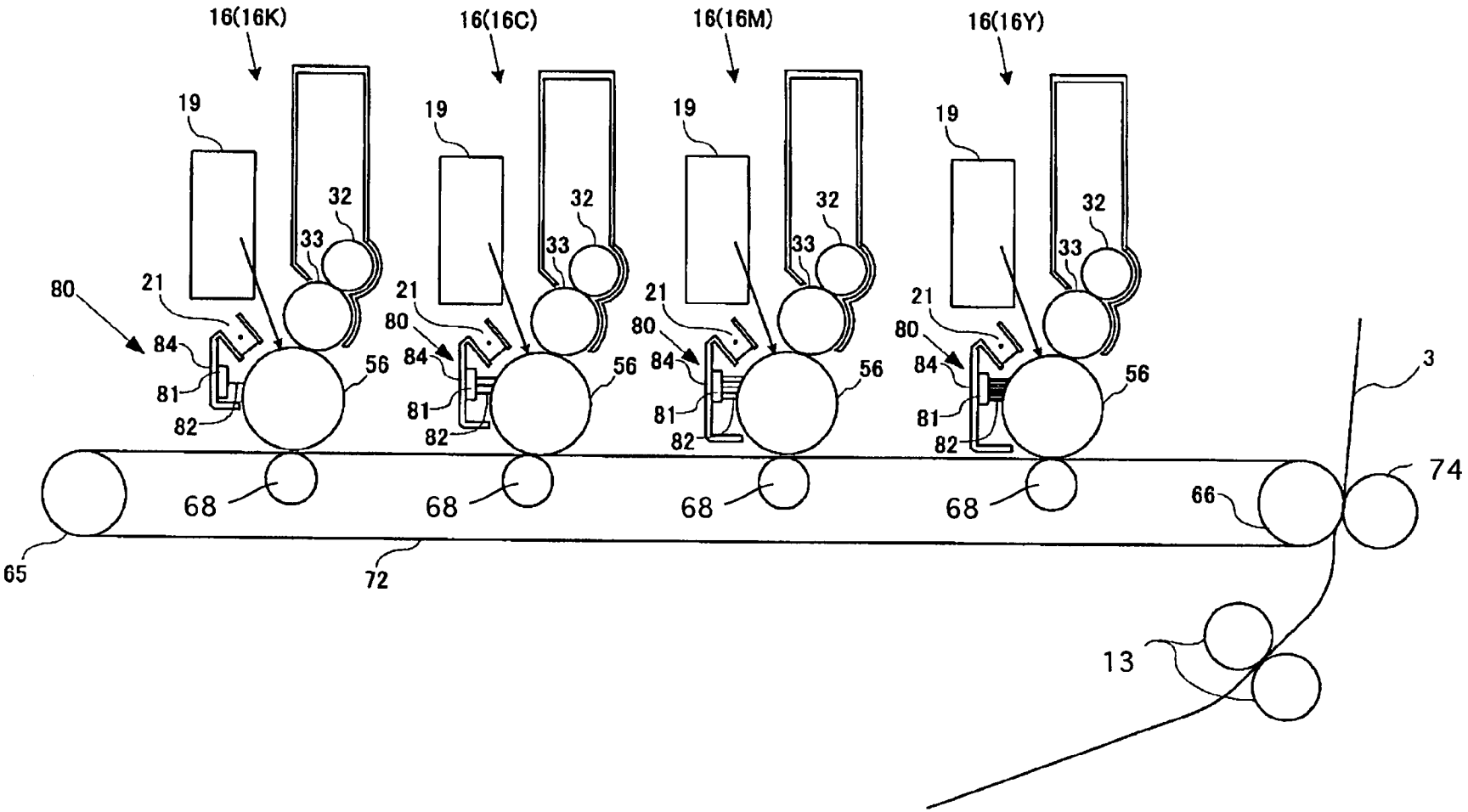
FIG. 8 is an elevational view corresponding to that of FIG. 3, showing a color laser printer according to a fifth embodiment of this invention wherein a toner image is transferred from an intermediate image transfer belt to a sheet of paper.

Referring further to FIG. 8, there will be described a color laser printer according to a fifth embodiment of this invention, which is different from the color laser printers of the preceding embodiments which are arranged such that the toner images are transferred from the photosensitive drums 56 directly to the paper sheet 3 fed by the conveyor belt 67, to form a color image. Namely, the color laser printer of the fifth embodiment of FIG. 8 is provided with an intermediate image transfer conveyor belt 72, which is different from the conveyor belt 67 provided to advance or feed the paper sheet 3. The intermediate image transfer conveyor belt 72 is provided to receive the yellow, magenta, cyan and black toner images from the photosensitive drums 56, in cooperation with the primary toner transfer rollers 68 held in contact with the inner surface of the upper span of the conveyor belt 72. The toner images thus received by the intermediate image transfer belt 72 are then transferred to the paper sheet 3, in cooperation with a secondary toner transfer roller 74 which cooperates with the driven roller 66 to pinch the paper sheet 3 fed by the paper feed rollers 14. Thus, the yellow, magenta, cyan and black toner images are sequentially transferred to the paper sheet 3 via the intermediate transfer conveyor belt 72, to form the color image on the paper sheet 3.

Although the color laser printers capable of performing a full color printing operation have been described above, the principle of the present invention is equally applicable to any image forming apparatus capable of forming toner images of a plurality of colors, in the form of a laser printer, an LED printer arranged to form a static latent image with light emitting diodes, a color copier, and a color facsimile machine, for example.

What is claimed is:

1. An image forming apparatus comprising a plurality of image forming units operable to form respective toner images of respective different colors on a toner-image receiving medium, each of said plurality of image forming units including (a) an image carrier, (b) a static-latent-image forming portion operable to form a static latent image on a surface of said image carrier, (c) a developing portion operable to apply a toner of a corresponding one of said different colors to the surface of the image carrier, according to said static latent image, for thereby forming the toner image of said corresponding color on the image carrier, and (d) a toner transferring portion operable to transfer said toner image from said image carrier to said toner-image receiving medium, said plurality of image forming units being disposed so as to be opposed to said toner-image receiving medium being fed in one direction, and operable to sequentially transfer the toner images from the image carriers to the toner-image receiving medium, wherein an improvement comprises:

said developing portion of each of said plurality of image forming units is operable to adsorb the toner remaining on the surface of said image carrier after the toner image formed last on said image carrier is transferred to said toner-image receiving medium; and each of at least one of said plurality of image forming units is provided with a dust removing portion operable to remove, from the surface of said image carrier, a paper dust which has been transferred to the surface of said image carrier during a transfer of the toner image from the image carrier to said toner-image receiving medium, said at least one of said plurality of image forming units including the most upstream one of the image forming units which is located at the most upstream position of the image forming apparatus and which is operated to transfer the toner image to the toner-image receiving medium before each of the other of said plurality of image forming units is operated to transfer the toner image to the toner-image receiving medium, wherein said dust removing portion of said most upstream image forming unit has an element that is in pressing contact with the image carrier, and has a dust removing capacity larger than that of the dust removing portion or portions of the other image forming unit or units.

2. The image forming apparatus according to claim 1, wherein said dust removing portion is not provided for at least one of said plurality of image forming units, which includes the most downstream one of the image forming units which is located at the most downstream position of the image forming apparatus and which is operated to transfer the toner image to the toner-image receiving medium after each of the other of said plurality of image forming units is operated to transfer the toner image to the toner-image receiving medium.

3. The image forming apparatus according to claim 1, wherein said plurality of image forming units comprise four image forming units operable to form respective toner images of respective yellow, magenta, cyan and black colors on the toner-image receiving medium, and the image forming unit operable to form the toner image of the yellow color is said most upstream one of the image forming units.

4. The image forming apparatus according to claim 1, wherein said plurality of image forming units comprise an image forming unit operable to form a toner image of a black color, which is located at the most downstream position of the image forming unit and which is operated to transfer the toner image of the black toner to the toner-image receiving medium after each of the other of said plurality of image forming units is operated to transfer the toner image to the toner-image receiving medium.

5. The image forming apparatus according to claim 1, wherein said plurality of image forming units comprise an image forming unit operable to form a toner image of a black color, which is said most upstream one of the image forming units.

6. The image forming apparatus according to claim 1, wherein said dust removing portion comprises a base member and a brush of fibers planted in said base member.

7. The image forming apparatus according to claim 1, wherein said dust removing portion comprises a non-woven fabric.

8. The image forming apparatus according to claim 1, wherein said dust removing portion comprises an electrically conductive body, and a bias-voltage applying portion operable to apply a bias voltage between said electrically conductive body and said image carrier, to facilitate removal of the dust from the image carrier.

9. The image forming apparatus according to claim 1, wherein said toner-image receiving medium is a recording medium to which the toner image is directly transferred by said toner transferring portion of said each image forming portion, from said image carrier.

10. The image forming apparatus according to claim 9, wherein said toner transferring portion includes a conveyor belt by which said recording medium is fed such that said plurality of image forming units are opposed to the recording medium placed on said conveyor belt when the toner images are transferred by said toner transferring portion from the image carrier directly to the recording medium.

11. The image forming apparatus according to claim 1, wherein said recording medium is an intermediate toner transfer belt, and said toner transferring portion includes said intermediate toner transfer belt, and is operable to transfer the toner image from said image carrier to said intermediate toner transfer belt, said toner transferring portion being further operable to transfer the toner image from said intermediate toner transfer belt to a recording medium.

12. The image forming apparatus according to claim 1, wherein said toner transferring portion is operable to finally transfer the toner image to a recording medium formed of a paper material, and wherein said dust removing portion is a paper dust removing portion operable to remove, from said image carrier, a paper dust which has been transferred to the surface of the image carrier during the transfer of the toner image from the image carrier to said toner-image receiving medium.

13. The image forming apparatus according to claim 1, wherein said developing portion of each of said plurality of image forming units functions as a roller-type toner removal device operable to adsorb the toner remaining on the surface of said image carrier, and said dust removing portion is a brush-type dust removal device operable to remove said dust from the surface of said image carrier.

14. The image forming apparatus according to claim 1, wherein the developing portion of each of said plurality of image forming units reuses the adsorbed toner in forming toner images.

15. The image forming apparatus according to claim 1, wherein said dust removing portion is not provided for at least one of said plurality of image forming units.

16. An image forming apparatus comprising a plurality of image forming units operable to form respective toner images of respective different colors on a toner-image receiving medium, each of said plurality of image forming units including (a) an image carrier, (b) a static-latent-image forming portion operable to form a static latent image on a surface of said image carrier, (c) a developing portion operable to apply a toner of a corresponding one of said different colors to the surface of the image carrier, according to said static latent image, for thereby forming the toner image of said corresponding color on the image carrier, and (d) a toner transferring portion operable to transfer said toner image from said image carrier to said toner-image receiving medium, said plurality of image forming units being disposed so as to be opposed to said toner-image receiving medium being fed in one direction, and operable to sequentially transfer the toner images from the image carriers to the toner-image receiving medium, wherein an improvement comprises:

said developing portion of each of said plurality of image forming units is operable to adsorb the toner remaining on the surface of said image carrier after the toner image formed last on said image carrier is transferred to said toner-image receiving medium; and each of at least one of said plurality of image forming units is provided with a dust removing portion operable to remove, from the surface of said image carrier, a paper dust which has been transferred to the surface of said image carrier during a transfer of the toner image from the image carrier to said toner-image receiving medium, said at least one of said plurality of image forming units including the most upstream one of the image forming units which is located at the most upstream position of the image forming apparatus and which is operated to transfer the toner image to the toner-image receiving medium before each of the other of said plurality of image forming units is operated to transfer the toner image to the toner-image receiving medium, wherein said at least one of said plurality of image forming units each of which is provided with said dust removing portion consists of said most upstream one of the image forming units, and at least one downstream image forming unit which is located adjacent to and downstream of said most upstream one of the image forming units, and wherein the dust removing portions of said most upstream one of the image forming units and said at least one downstream image forming units have dust removing capacities which are determined such that the dust removing capacity of the dust removing portion of one of two adjacent ones of the image forming units which is located downstream of the other of said two adjacent ones is not larger than that of said other of said two adjacent ones.

17. The image forming apparatus according to claim 16, wherein the dust removing portion of each of said most upstream image forming unit and said at least one downstream image forming unit is held in contact with the surface of the image carrier, to remove the dust from the surface of the image carrier, and wherein the dust removing portions of said most upstream image forming unit and said at least one downstream image forming units have pressures of contact with the surfaces of the corresponding image carriers, which pressures of contact are determined such that the pressure of contact of the dust removing portion of said one of the two adjacent ones of the image forming units is not higher than that of said other of said two adjacent ones.

18. The image forming apparatus according to claim 16, wherein the dust removing portion of each of said most upstream image forming unit and said at least one downstream image forming unit is held in contact with the surface of the image carrier, to remove the dust from the surface of the image carrier, and wherein the dust removing portions of said most upstream image forming unit and said at least one downstream image forming units have dimensions of contact with the surfaces of the corresponding image carriers in a direction of movement of said surfaces, which dimensions of contact are determined such that the dimension of contact of the dust removing portion of said one of the two adjacent ones of the image forming units is not larger than that of said other of said two adjacent ones.

19. The image forming apparatus according to claim 16, wherein the dust removing portion of each of said most upstream image forming unit and said at least one downstream image forming unit comprises a base member and a brush of fibers planted in said base member, and wherein the brushes of fibers of the dust removing portions of said most upstream image forming unit and said at least one downstream image forming units have densities which are determined such that the density of the brush of fibers of the dust removing portion of said one of the two adjacent ones of the image forming units is not higher than that of said other of said two adjacent ones.

20. The image forming apparatus according to claim 16, wherein the dust removing portion of each of said most upstream image forming unit and said at least one downstream image forming unit comprises an electrically conductive body, and a bias-voltage applying portion operable to apply a bias voltage between said electrically conductive body and said image carrier, to facilitate removal of the dust from the image carrier and wherein the bias voltages applied by the bias-voltage applying portions of the dust removing portions of said most upstream image forming unit and said at least one downstream image forming units are determined such that the bias voltage applied by the bias-voltage applying portion of the dust removing portion of said one of the two adjacent ones of the image forming units is not higher than that of said other of said two adjacent ones.

21. The image forming apparatus according to claim 16, wherein the dust removing portion of each of said most upstream image forming unit and said at least one downstream image forming unit comprises a dust container for storing the dust removed from said image carrier, and wherein the dust removing portions of said most upstream image forming unit and said at least one downstream image forming units have storage capacities which are determined such that the storage capacity of the dust container of the dust removing portion of said one of the two adjacent ones of the image forming units is not larger than that of said other of said two adjacent ones.

22. An image forming apparatus comprising a plurality of image forming units operable to form respective toner images of respective different colors on a toner image receiving medium, each of said plurality of image forming units including (a) an image carrier, (b) a static-latent-image forming portion operable to form a static latent image on a surface of said image carrier, (c) a developing portion operable to apply a toner of a corresponding one of said different colors to the surface of the image carrier, according to said static latent image, for thereby forming the toner image of said corresponding color on the image carrier, and (d) a toner transferring portion operable to transfer said toner image from said image carrier to said toner-image receiving medium, said plurality of image forming units being disposed so as to be opposed to said toner-image receiving medium being fed in one direction, and operable to sequentially transfer the toner images from the image carriers to the toner-image receiving medium, wherein an improvement comprises:

said developing portion of each of said plurality of image forming units is operable to adsorb the toner remaining on the surface of said image carrier after the toner image formed last on said image carrier is transferred to said toner-image receiving medium; and each of at least one of said plurality of image forming units is provided with a dust removing portion operable to remove, from the surface of said image carrier, a dust which has been transferred to the surface of said image carrier during a transfer of the toner image from the image carrier to said toner-image receiving medium, said at least one of said plurality of image forming units including the most upstream one of the image forming units which is located at the most upstream position of the image forming apparatus and which is operated to transfer the toner image to the toner-image receiving medium before each of the other of said plurality of image forming units is operated to transfer the toner image to the toner-image receiving medium, and wherein said dust removing portion of said most upstream image forming unit has an element that is in pressing contact with the image carrier, and has a dust removing capacity larger than that of the dust removing portion or portions of the other image forming unit or units.

23. An image forming apparatus comprising a plurality of image forming units operable to form respective toner images of respective different colors on a toner-image receiving medium, each of said plurality of image forming units including (a) an image carrier, (b) a static-latent-image forming portion operable to form a static latent image on a surface of said image carrier, (c) a developing portion operable to apply a toner of a corresponding one of said different colors to the surface of the image carrier, according to said static latent image, for thereby forming the toner image of said corresponding color on the image carrier, and (d) a toner transferring portion operable to transfer said toner image from said image carrier to said toner-image receiving medium, said plurality of image forming units being disposed so as to be opposed to said toner-image receiving medium being fed in one direction, and operable to sequentially transfer the toner images from the image carriers to the toner-image receiving medium, wherein an improvement comprises:

said developing portion of each of said plurality of image forming units is operable to adsorb the toner remaining of the surface of said image carrier after the toner image formed last on said image carrier is transferred to said toner-image receiving medium; and each of at least one of said plurality of image forming units is provided with a dust removing portion operable to remove, from the surface of said image carrier, a dust other than the toner, which dust has been transferred to the surface of said image carrier during a transfer of the toner image from the image carrier to said toner-image receiving medium, said at least one of said plurality of image forming units including the most upstream one of the image forming units which is located at the most upstream position of the image forming apparatus and which is operated to transfer the toner image to the toner-image receiving medium before each of the other of said plurality of image forming units is operated to transfer the toner image to the toner-image receiving medium, wherein said dust removing portion of said most upstream image forming unit has an element that is in pressing contact with the image carrier, and has a dust removing capacity larger than that of the dust removing portion or portions of the other image forming unit or units.

24. The image forming apparatus according to claim 23, wherein said toner is a toner which is positively chargeable to have a polarity opposite to that of said dust.

* * * * *